US012031540B2

(12) United States Patent
Nam et al.

(10) Patent No.: US 12,031,540 B2
(45) Date of Patent: Jul. 9, 2024

(54) COMPRESSOR AND ELECTRONIC DEVICE USING THE SAME

(71) Applicant: Samsung Electronics Co., Ltd., Suwon-si (KR)

(72) Inventors: Jahyun Nam, Suwon-si (KR); Jaewoo Park, Suwon-si (KR); Duhwa Jung, Suwon-si (KR)

(73) Assignee: SAMSUNG ELECTRONICS CO., LTD.

( * ) Notice: Subject to any disclaimer, the term of this patent is extended or adjusted under 35 U.S.C. 154(b) by 602 days.

(21) Appl. No.: 17/269,668

(22) PCT Filed: Aug. 21, 2019

(86) PCT No.: PCT/KR2019/010635
§ 371 (c)(1),
(2) Date: Feb. 19, 2021

(87) PCT Pub. No.: WO2020/040540
PCT Pub. Date: Feb. 27, 2020

(65) Prior Publication Data

US 2021/0363994 A1 Nov. 25, 2021

(30) Foreign Application Priority Data

Aug. 21, 2018 (KR) ..... 10-2018-0097716

(51) Int. Cl.
*F04C 29/06* (2006.01)
*F04C 18/063* (2006.01)

(52) U.S. Cl.
CPC ..... *F04C 29/065* (2013.01); *F04C 18/063* (2013.01); *F04C 29/061* (2013.01)

(58) Field of Classification Search
CPC ..... F04B 39/0055; F04B 39/0061; F04B 39/0066; F04C 29/061; F04C 29/062; F04C 29/068
See application file for complete search history.

(56) References Cited

U.S. PATENT DOCUMENTS 4,881,879 A 11/1989 Ortiz
6,176,687 B1 1/2001 Kim et al.
(Continued)

FOREIGN PATENT DOCUMENTS

CN 103615372 A 3/2014
CN 203614354 U 5/2014
(Continued)

OTHER PUBLICATIONS

Office Action dated Mar. 31, 2023 in European Patent Application No. 19 852 606.3.
(Continued)

*Primary Examiner* — Kenneth J Hansen
(74) *Attorney, Agent, or Firm* — STAAS & HALSEY LLP

(57) ABSTRACT

The disclosure relates to a compressor having a noise reduction resonator. The compressor includes: a compression part having compression space in which introduced gas is accommodated, and configured to compress and discharge the gas in the compression space; and a gas moving part having an inner wall forming a gas flow path through which the gas discharged from the compression space moves, wherein the gas moving part is provided with a first resonator configured to communicate with the gas flow path on the inner wall forming the gas flow path and having a resonance space depressed upward in a moving direction of the gas. The compressor according to the disclosure may prevent compression efficiency from decreasing and maintain a noise reduction effect for a long period of time by
(Continued)

preventing foreign objects or liquids from being accumulated in the resonance space.

14 Claims, 20 Drawing Sheets

(56) References Cited

U.S. PATENT DOCUMENTS

| | | | | |
|---|---|---|---|---|
| 6,447,274 | B1 | 9/2002 | Horihata et al. | |
| 2010/0278674 | A1* | 11/2010 | Byun | F04C 23/001 418/60 |

FOREIGN PATENT DOCUMENTS

| | | | |
|---|---|---|---|
| EP | 1 820 970 | A1 | 8/2007 |
| JP | 2-169891 | | 6/1990 |
| JP | 6-52078 | | 2/1994 |
| JP | 2001-280241 | | 10/2001 |
| KR | 20-1999-0002724 | | 1/1999 |
| KR | 1999-0043510 | | 6/1999 |
| KR | 2000-0032597 | | 6/2000 |
| KR | 10-0286837 | | 1/2001 |
| KR | 2002-0001029 | | 1/2002 |
| KR | 10-2005-0096772 | A | 10/2005 |
| KR | 10-2006-0024717 | | 3/2006 |
| KR | 10-2006-0024739 | | 3/2006 |
| KR | 10-2010-0044374 | | 4/2010 |
| KR | 10-2018-0091148 | | 8/2018 |

OTHER PUBLICATIONS

Korean Office Action dated Jul. 20, 2022 for Korean Application No. 10-2018-0097716.

International Search Report of International Application No. PCT/KR2019/010635 dated Dec. 20, 2019, 4 pages.

Extended European Search Report dated Aug. 18, 2021 from European Application No. 19852606.3, 11 pages.

Zhang et al., "Investigation on Multi-Helmholtz Reasonator in the Discharge System of Rotary Compressor", International Compressor Engineering Conference, Jul. 2010, 7 pages.

* cited by examiner

COMPRESSOR AND ELECTRONIC DEVICE USING THE SAME

CROSS-REFERENCE TO RELATED APPLICATIONS

This application is a U.S. National Stage Application, which claims the benefit under 35 U.S.C. § 371 of PCT International Patent Application No. PCT/KR2019/010635, filed Aug. 21, 2019 which claims the foreign priority benefit under 35 U.S.C. § 119 of Korean Patent Application No. 10-2018-0097716, filed Aug. 21, 2018, the contents of which are incorporated herein by reference.

TECHNICAL FIELD

The disclosure relates to an electronic device using a compressor, such as an air conditioner, a refrigerator, or a freezer, and more particularly, to a compressor including a noise reduction resonator for reducing noise generated in a gas flow path through which compressed gas moves.

BACKGROUND ART

A compressor refers to a mechanical device that increases pressure by compressing gas, and is divided into a reciprocating type compressor and a rotary type compressor according to the operating principle. The reciprocating type compressor is a type that converts a rotational motion of a motor into a linear reciprocating motion of a piston through a crankshaft and a connecting rod to suck and compress gas. Examples of the rotary type compressor include a rotary compressor that sucks and compresses gas while a roller rotates in a cylinder by a rotational motion of a motor and a scroll compressor that continuously sucks and compresses gas while a turning scroll performs an orbital motion in a certain direction from a center of a fixed scroll by a rotational motion of a rotary compressor for performing compression and a motor. In these compressors, a muffler is typically used to reduce noise. However, as the compressors have recently become more efficient, noise is greatly increased, so the existing mufflers have limitations in reducing noise.

In addition, the existing compressor is provided with a noise reduction resonator provided in a compression space to reduce noise. The noise reduction resonator provided in the compression space as described above has a problem of reducing the compression efficiency of the compressor.

In addition, a technology to reduce noise by employing a multi-Helmholtz resonator on an upper flange of a compressor cylinder has been announced in a paper published by the International Compressor Engineering Conference in July 2010, entitled "Invention on Multi-Helmholtz Resonator in the Discharge System of Rotary Compressor" by Ronzing Zhang et al. However, since the resonator of the prior art is located downward in the traveling direction of the gas flow path, foreign matter or liquid may be accumulated when used for a long period of time, thereby reducing the noise reduction effect.

DISCLOSURE

Technical Problem

Accordingly, an object of the disclosure is to provide a compressor having a noise reduction resonator capable of maintaining a noise reduction effect even when used for a long period of time and an electronic device using the same.

Technical Solution

According to an aspect of the present disclosure, a compressor includes: a compression part having compression space in which introduced gas is accommodated, and configured to compress and discharge the gas in the compression space; and a first gas moving part having a first gas flow path through which the gas discharged from the compression space moves, wherein the first gas moving part is provided with a first resonator configured to communicate with the first gas flow path and having a resonance space depressed upward in a moving direction of the gas.

The compression part may include a cylinder forming the compression space, and the first gas moving part may include: a lower flange coupled to a lower portion of the cylinder and having a gas discharge port for discharging the gas compressed in the compression space; and a lower muffler coupled to the lower flange to form the first gas flow path. As a result, in the rotary type compressor, the lower flange located above the gas flow path above a traveling direction of the gas flow path located between the lower flange and the lower muffler may be provided with a noise reduction resonator.

The compression part may include a cylinder forming the compression space, and the first gas moving part may include: an upper flange coupled to an upper portion of the cylinder and having a gas discharge port for discharging the gas compressed in the compression space; and an upper muffler coupled to the upper flange to form the first gas flow path.

The compressor may further include: a second gas moving part having a second gas flow path through which the gas discharged from the compression space moves, the second gas moving part may include: an upper flange coupled to an upper portion of the cylinder and having a gas discharge port for discharging the gas compressed in the compression space; and an upper muffler coupled to the upper flange to form the second gas flow path, and the second gas moving part may be provided with a second resonator configured to communicate with the second gas flow path and having a resonance space depressed upward in a moving direction of the gas.

The compressor may further include: a second gas moving part having a second gas flow path through which the gas discharged from the compression space moves, the second gas moving part may include: an upper flange coupled to an upper portion of the cylinder and having a gas discharge port for discharging the gas compressed in the compression space; and an upper muffler coupled to the upper flange to form the second gas flow path, and the second gas moving part may be provided with a second resonator configured to communicate with the second gas flow path and having a resonance space depressed downward in a moving direction of the gas.

The second gas moving part may include a third gas flow path, and the first gas flow path and the third gas flow path may be connected to each other.

The second gas flow path and the third gas flow path may communicate with each other.

The first gas moving part may be further provided with a second resonator configured to communicate with the first gas flow path and having a resonance space depressed upward in a moving direction of the gas, and the second resonator may be configured to be depressed across the lower flange and the cylinder.

The first gas moving part may be further provided with a second resonator configured to communicate with the first gas flow path and having a resonance space depressed upward in a moving direction of the gas, and the second resonator may have a resonance space having a depth different from that of the first resonator.

The first resonator may be located within a range of 170° from the gas discharge port with respect to a center of the lower flange.

The first resonator may include an inlet part configured to communicate with the first gas flow path, a neck part configured to extend from the inlet part, and a chamber configured to extend from the neck part and having a larger diameter than the neck part.

The inlet part may include an inclined portion configured to be inclined to narrow toward the neck part.

The inlet part may include a multi-stage inclined portion configured to be inclined in multi-stage so as to be narrowed toward the neck part.

The inlet part may include an inclined portion configured to be inclined at a predetermined curvature so as to be narrowed toward the neck part.

The chamber and the neck part may each have a cylindrical shape that has a first diameter $d_c$ and a second diameter $d_n$, and the second diameter $d_n$ may be 10 to 90% relative to the first diameter $d_c$.

The chamber and the neck part may each have a cylindrical shape having a first diameter $d_c$ and a second diameter $d_n$, the inlet part may have a truncated cone shape configured to decrease from a maximum diameter $de_{max}$ to a minimum diameter $de_{min}$, and the maximum diameter $de_{max}$ may be greater than the first diameter $d_c$.

According to another aspect of the present disclosure, an electronic device including a compressor includes: a cylinder having a compression space in which introduced gas is accommodated, and configured to compress and discharge the gas in the compression space; and a lower flange coupled to the lower part of the cylinder; a lower muffler coupled to a bottom surface portion of the lower flange and having an inner surface portion forming a gas flow path through which the gas discharged from the compression space moves together with the bottom surface portion of the lower flange; and a resonator formed on a bottom surface portion of the lower flange and configured to communicate with the gas flow path and having a resonance space depressed upward in a moving direction of the gas.

Advantageous Effects

According to the disclosure, the compressor has no reduction in compression efficiency, and can maintain the noise reduction efficiency even when used for a long period of time.

MODE FOR DISCLOSURE

Hereinafter, in this document, a compressor 1 used in electronic devices such as an air conditioner, a refrigerator, and a freezer will be described in detail with reference to the accompanying drawings. Embodiments described below describe a sealed reciprocating type compressor 1 to aid understanding of the disclosure, which is illustrative. Unlike the embodiments described herein, it should be understood that various modifications such as a reciprocating type compressor and a scroll compressor may be implemented. However, when it is decided that a detailed description for the known functions or components related to the disclosure may obscure the gist of the disclosure, the detailed description and concrete illustration will be omitted.

Figure 1:
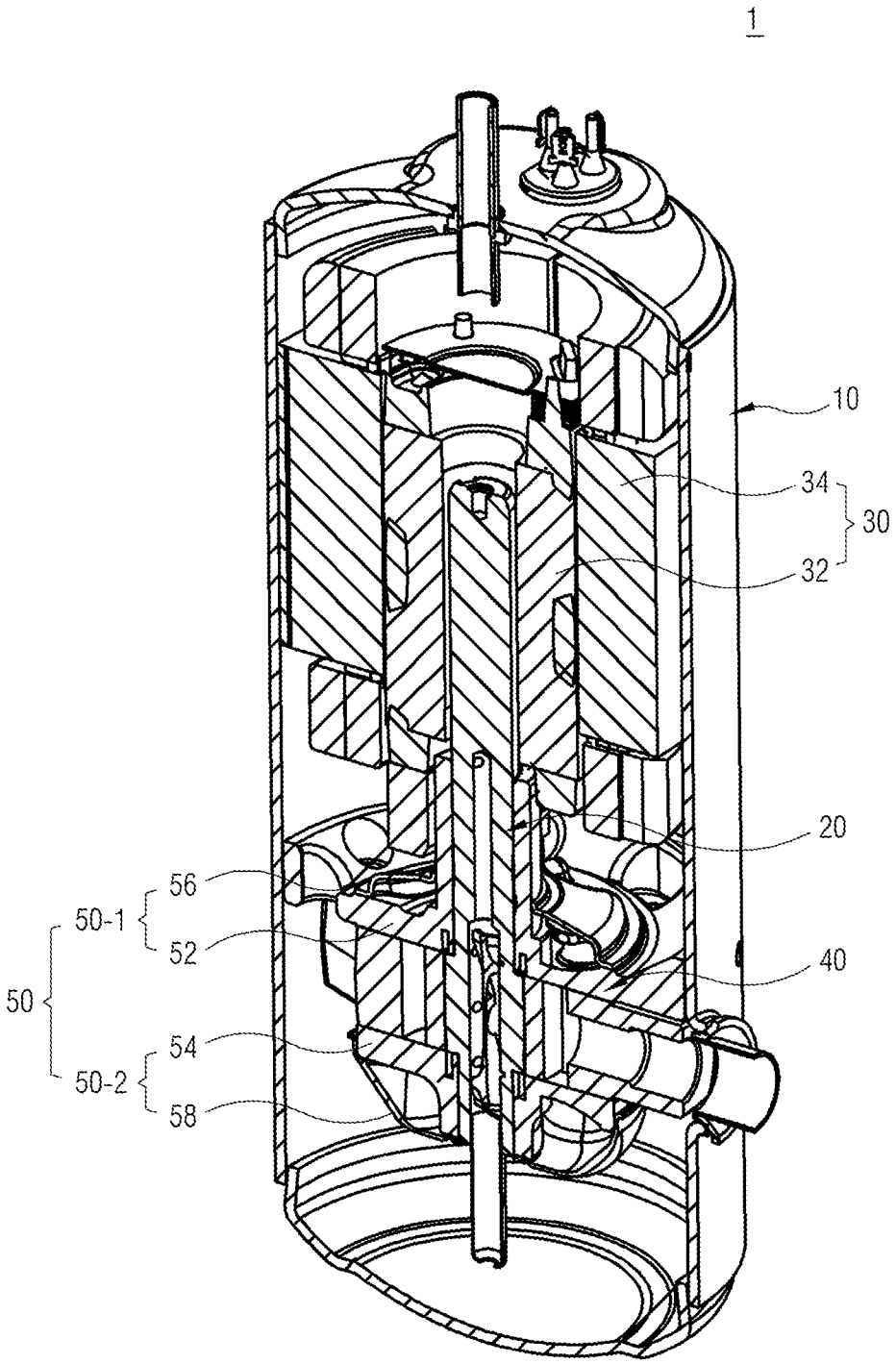
FIG. 1 is a perspective view illustrating an internal configuration of a compressor according to an embodiment of the disclosure.

FIG. 1 is a perspective view illustrating an internal configuration of a sealed rotary compressor 1 according to an embodiment of the disclosure. A sealed rotary compressor 1 according to an embodiment of the disclosure includes a sealed container 10 having an internal space, a rotating shaft 20 rotatably extending up and down in the container 10, a motor 30 provided on one side of the rotating shaft 20, a compression part 40 provided on the other side of the rotating shaft 20, and a gas moving part 50 that discharges and moves gas compressed in the compression part 40.

The sealed container 10 has a cylindrical shape and accommodates the rotating shaft 20, the motor 30, the compression part 40, and the gas moving part 50 in an inner space.

The rotating shaft 20 is rotatably installed in a center of the sealed container 10 in a vertical direction. The rotating shaft 20 is coupled to a rotor 32 of the motor 30 on one side of an upper portion thereof. The rotating shaft 20 is coupled to a roller 44 of the compression part 40 on the other side of a lower portion thereof. Therefore, the rotating shaft 20 rotates as the rotor 32 of the motor 30 rotates, and as a result, the roller 44 of the lower compression part 40 also rotates.

The motor 30 includes the rotor 32 fixed to the rotating shaft 20 and a stator 34 spaced apart from the rotor 32 at a predetermined interval. The rotor 32 is usually composed of a permanent magnet. The stator 34 is composed of a coil wound multiple times. In the motor 30, when a current is applied to the coil of the stator 34, a magnetic field is generated to make the stator 34 interact with the permanent magnet of the rotor 32 adjacently disposed thereto, thereby rotating the rotor 32. As the rotor 32 rotates, the rotating shaft 20 also rotates, and as a result, a torque of the motor 30 causes the roller 44 at the other end of a lower portion thereof to rotate through the rotating shaft 20.

Figure 2:
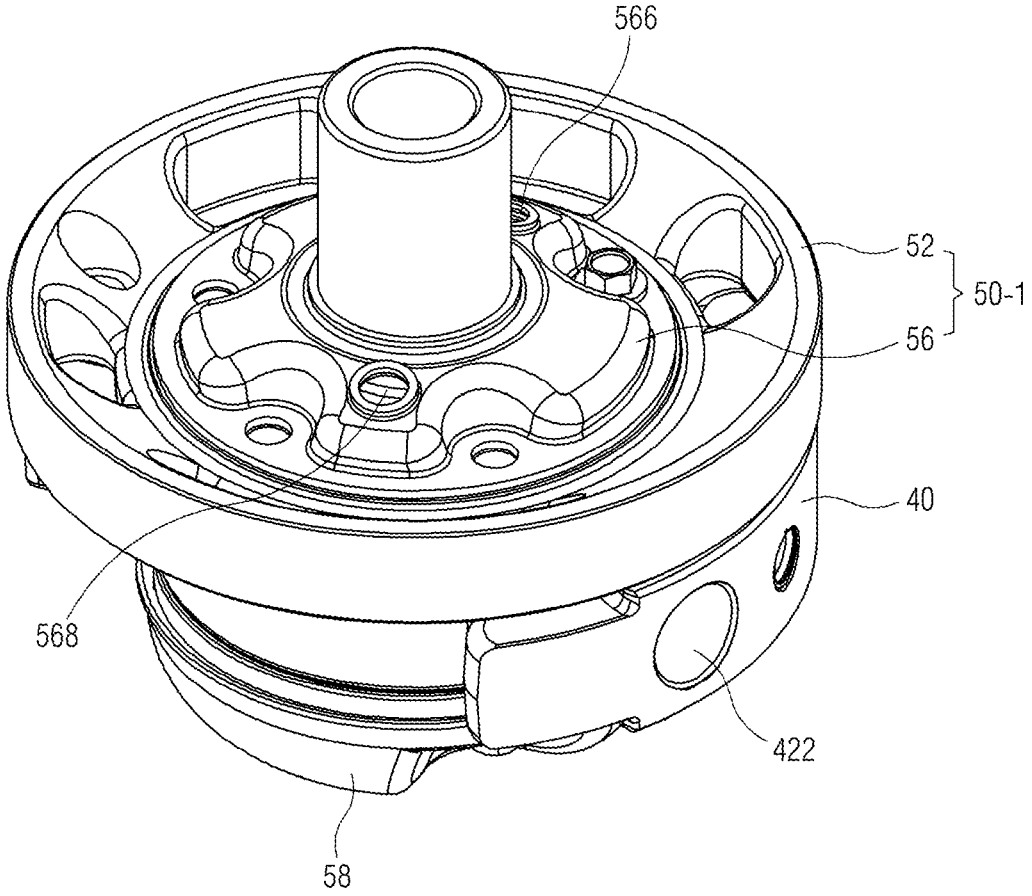
FIG. 2 is a perspective view illustrating a coupled state of a compression part and a gas moving part in the compressor according to the embodiment of the disclosure.
Figure 3:
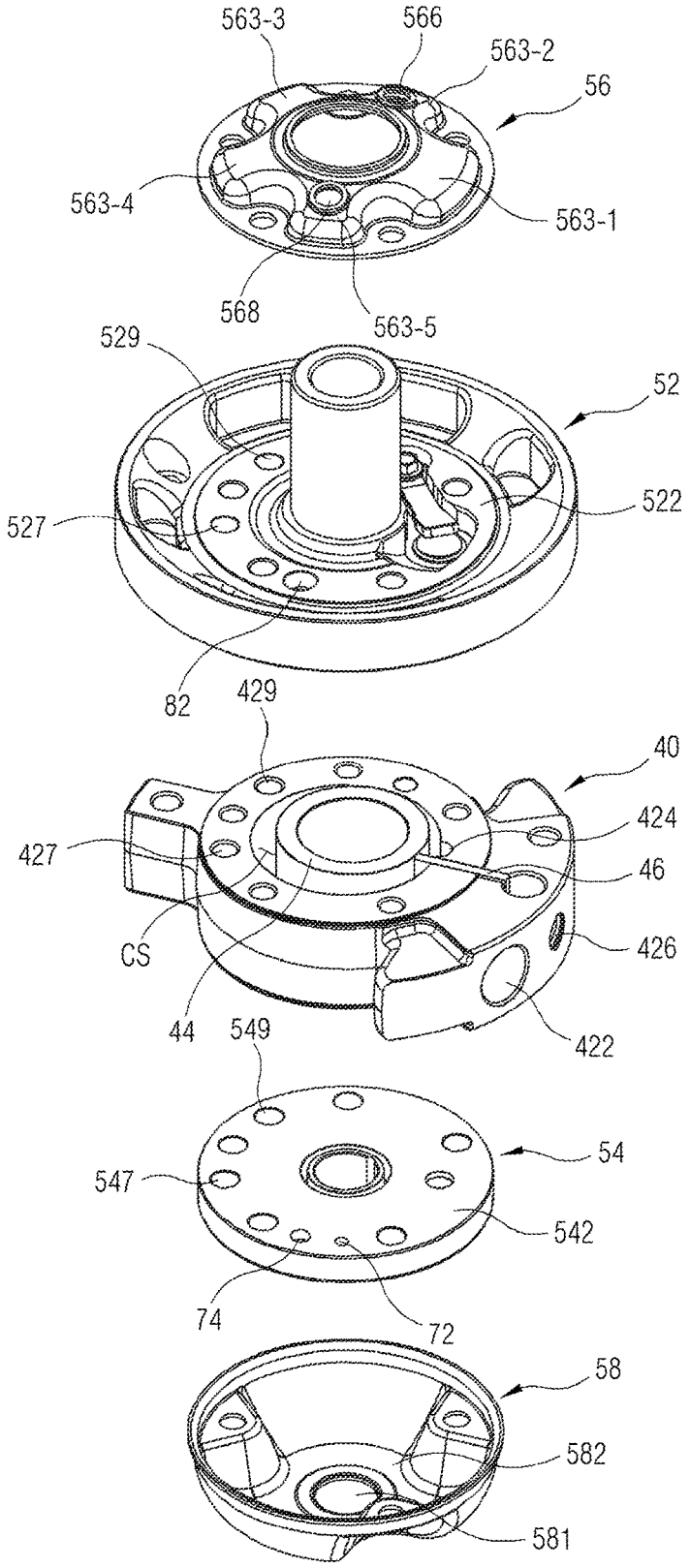
FIGS. 3 and 4 are exploded perspective views illustrating the compression part and the gas moving part in the compressor according to the embodiment of the disclosure.
Figure 4:
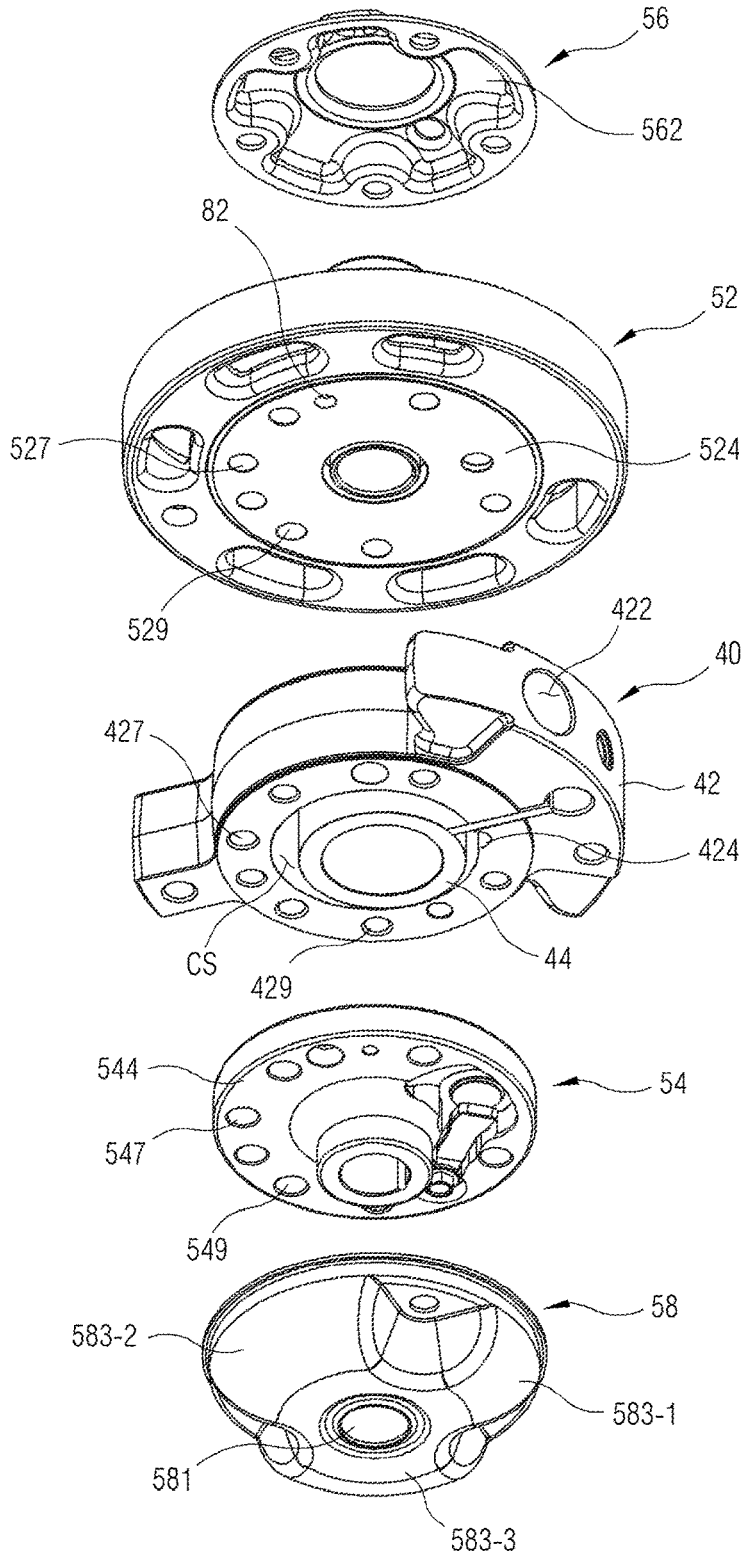

FIG. 2 is a perspective view illustrating a coupled state of the compression part 40 and the gas moving part 50 in a compressor according to the embodiment of the disclosure, and FIGS. 3 and 4 are exploded perspective views of the compression part 40 and the gas moving part 50 in the compressor 1 according to the embodiment of the disclosure.

The compression part 40 includes a cylinder 42 having a cylindrical compression space CS therein, a roller 44 provided in the cylinder 42, a plate-shaped vane 46 blocking between an inner wall of the cylinder 42 and an outer wall of the roller 44, a spring (see 48 in FIG. 5) so that the vane 46 elastically protrudes toward the outer wall of the roller 44, a bottom surface portion 524 of an upper flange 52 shielding an upper portion of the compression space CS of the cylinder 42, and a top surface portion 542 of a lower flange 54 shielding a lower portion of the compression space CS of the cylinder 42 The compressor 40 illustrated in FIGS. 2 to 8 has been described as a structure in which gas is discharged to the upper portion or the lower portion and a single roller and cylinder are used, which is only one example for explanation. That is, the structure in which the gas is discharged to either the upper portion or the lower portion or to the side surface, or two or more rollers and cylinders are used may be applied.

The cylinder 42 includes a gas suction port 422 that communicates with the cylindrical compression space CS by penetrating through the side surface, and a gas discharge channel 424 that depressed concavely up and down in the inner wall of the compression space CS and extends.

The cylinder 42 includes two gas flow path connecting portions 427 and 429 penetrating through the cylinder 42 up and down. The two gas flow path connecting parts 427 and 429 connects a lower gas flow path (see 70 in FIG. 8) of a lower gas moving part 50-2 to be described later and an upper second gas flow path (see 61 in FIG. 8) of an upper gas moving part 50-1. The gas discharged to the lower gas flow path 70 of the lower portion of the cylinder 42 moves through the gas flow path 70 and passes through the first and second gas flow path connecting parts 427 and 429, and is then discharged to the outside through the upper second gas flow path 61 of the upper portion of the cylinder 42.

The roller 44 is disposed in the compression space CS of the cylinder 42 while being fixed to one end of the rotating shaft 20. The roller 44 has a cylindrical shape having a diameter smaller than that of the cylindrical compression space CS, and rotates within the compression space CS according to the rotation of the rotating shaft 20 by the rotor 32 of the motor 30. At this time, the roller 44 does not rotate concentrically with the compression space CS, but is provided so that the roller 44 is deflected from the center of the compression space CS, and the roller 44 rotates while the outer wall of the roller 44 keeps close to the inner wall of the compression space CS.

The vane 46 are installed to protrude elastically by the spring 48 from the inner wall of the compression space CS toward the outer wall of the roller 44 in a plate shape, or to compress and move the spring 48 in the opposite direction. As a result, the vane 46 always keeps elastically pressed against and contacted with the outer wall of the roller 44 while the roller 44 rotates by the spring 48. In the compression space CS, a gas suction port 422 is located on one side, and a gas discharge channel 424 is located on the opposite side, based on the vane 46. Therefore, the gas sucked in the gas suction port 422 in the cylinder 42 is compressed according to the rotation of the roller 44, and is then discharged through upper and lower gas discharge ports (see 526 and 546 in FIG. 8) of the upper and lower flanges 52 and 54.

Hereinafter, a process of sucking, compressing, and discharging gas in the cylinder 42 will be described with reference to FIGS. 5 to 7.

Figure 5:
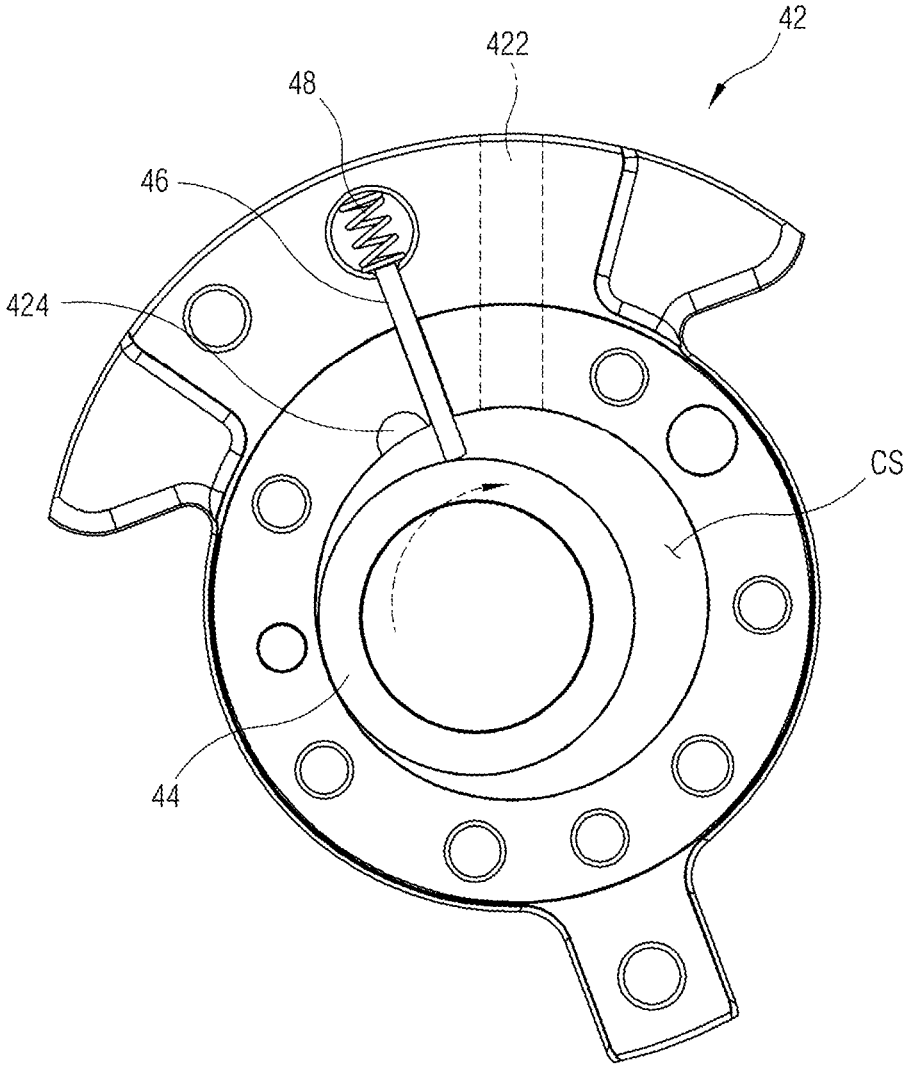
FIGS. 5 to 7 are plan views illustrating a step-by-step operation of the compression part according to the embodiment of the disclosure.

FIG. 5 illustrates the state in which the gas is completely sucked into the compression space CS of the cylinder 42 through the gas suction port 422 and the compressed gas is discharged while the roller 44 is located in the gas discharge channel 424 on the left side based on the vane 46.

Figure 6:
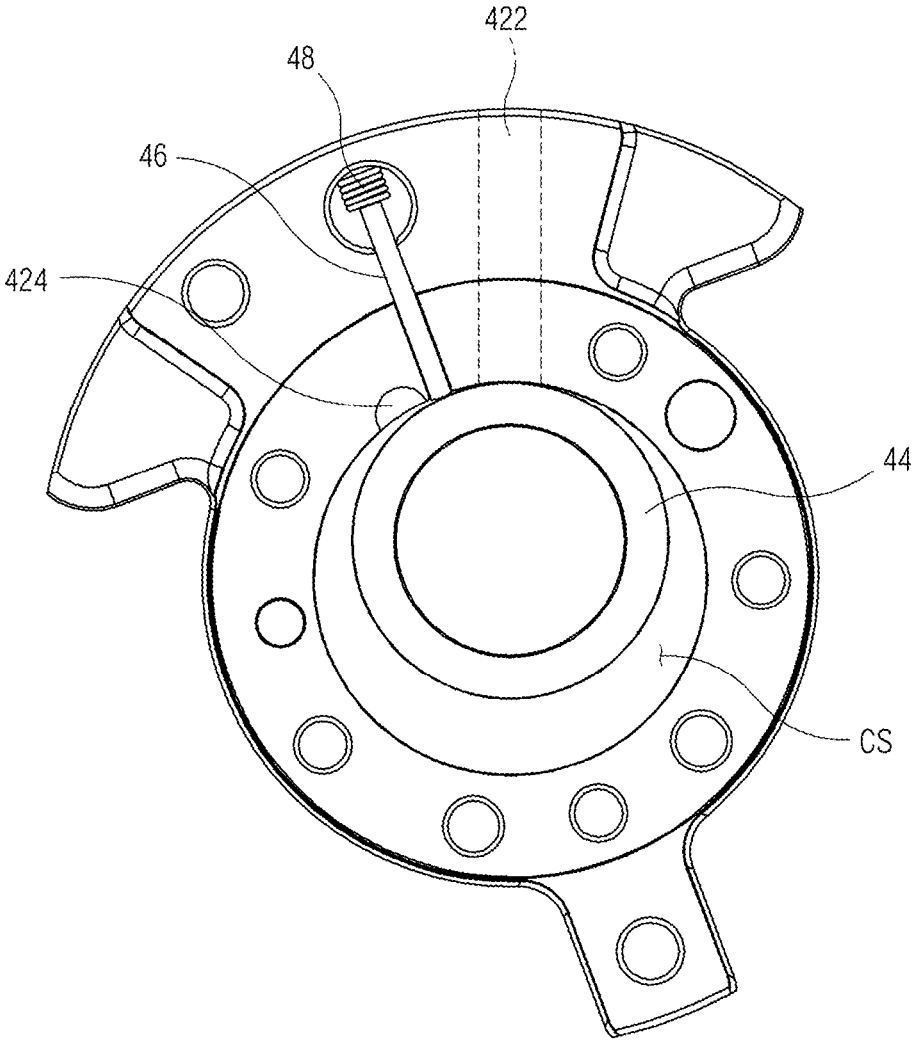

FIG. 6 illustrates a state in which the roller 44 blocks the gas suction port 422 while the roller 44 rotates right along the inner wall of the cylinder 42.

Figure 7:
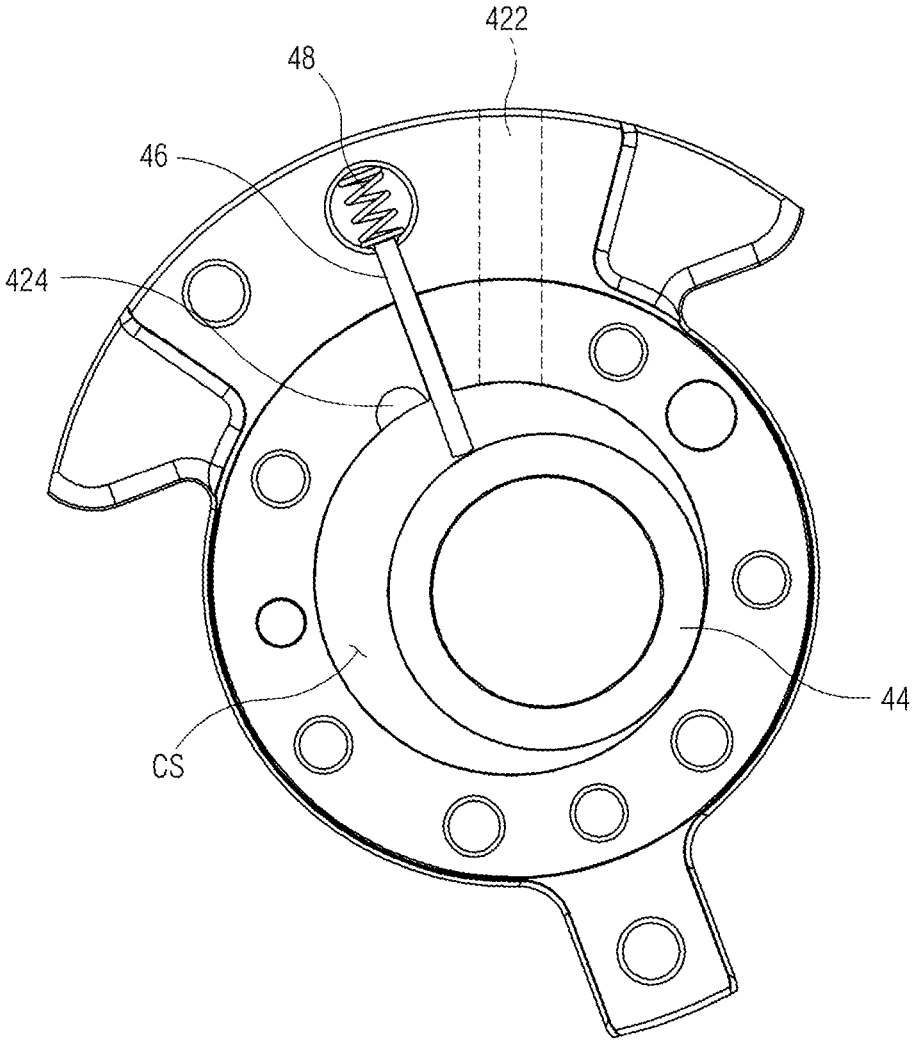

FIG. 7 illustrates that the gas already sucked into the cylinder 42 is compressed and at the same time a new gas is sucked through the gas suction port 422 while the roller 44 rotates right along the inner wall of the cylinder 42.

Thereafter, when the roller 44 continues to rotate right, the compressed gas as illustrated in FIG. 5 is discharged through the upper and lower gas discharge ports 526 and 546 of the upper and lower flanges 52 and 54 that communicate with the upper and lower portions of the gas discharge channel 424.

Figure 8:
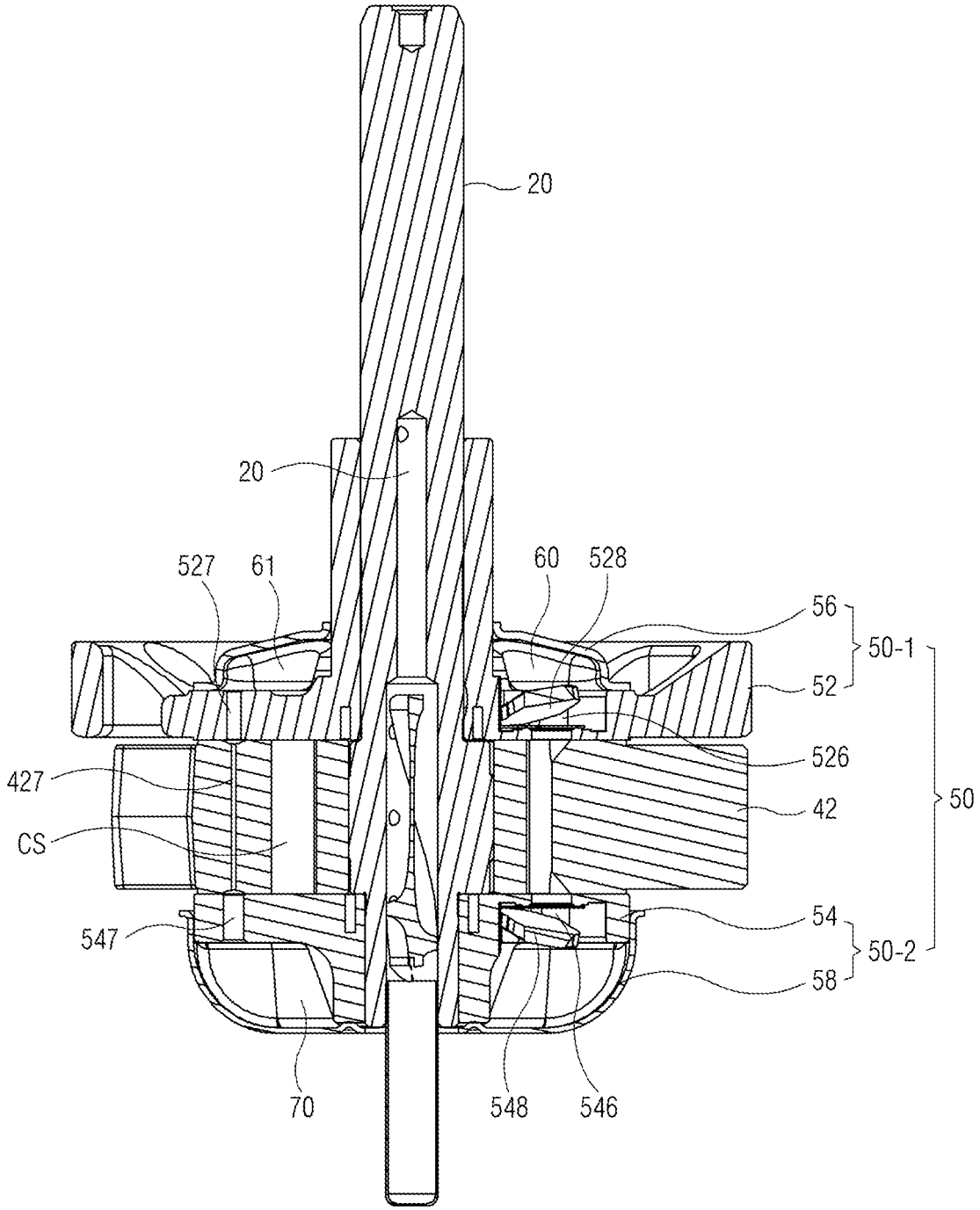
FIG. 8 is a cross-sectional view of the compression part and the gas moving part in the compressor according to the embodiment of the disclosure.
Figure 9:
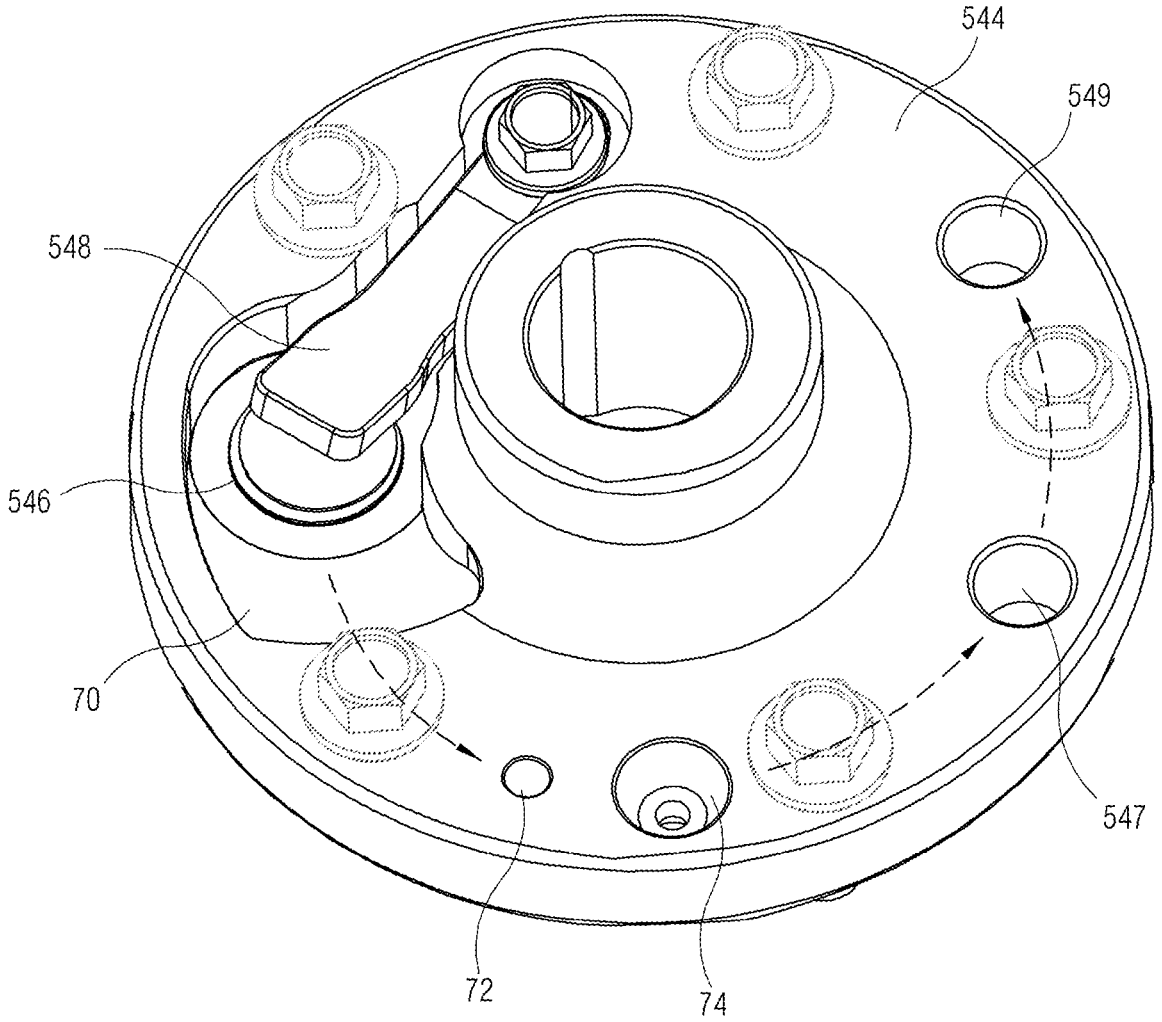
FIG. 9 is a perspective view illustrating a bottom surface of a lower flange in the compressor according to the embodiment of the disclosure.
Figure 10:
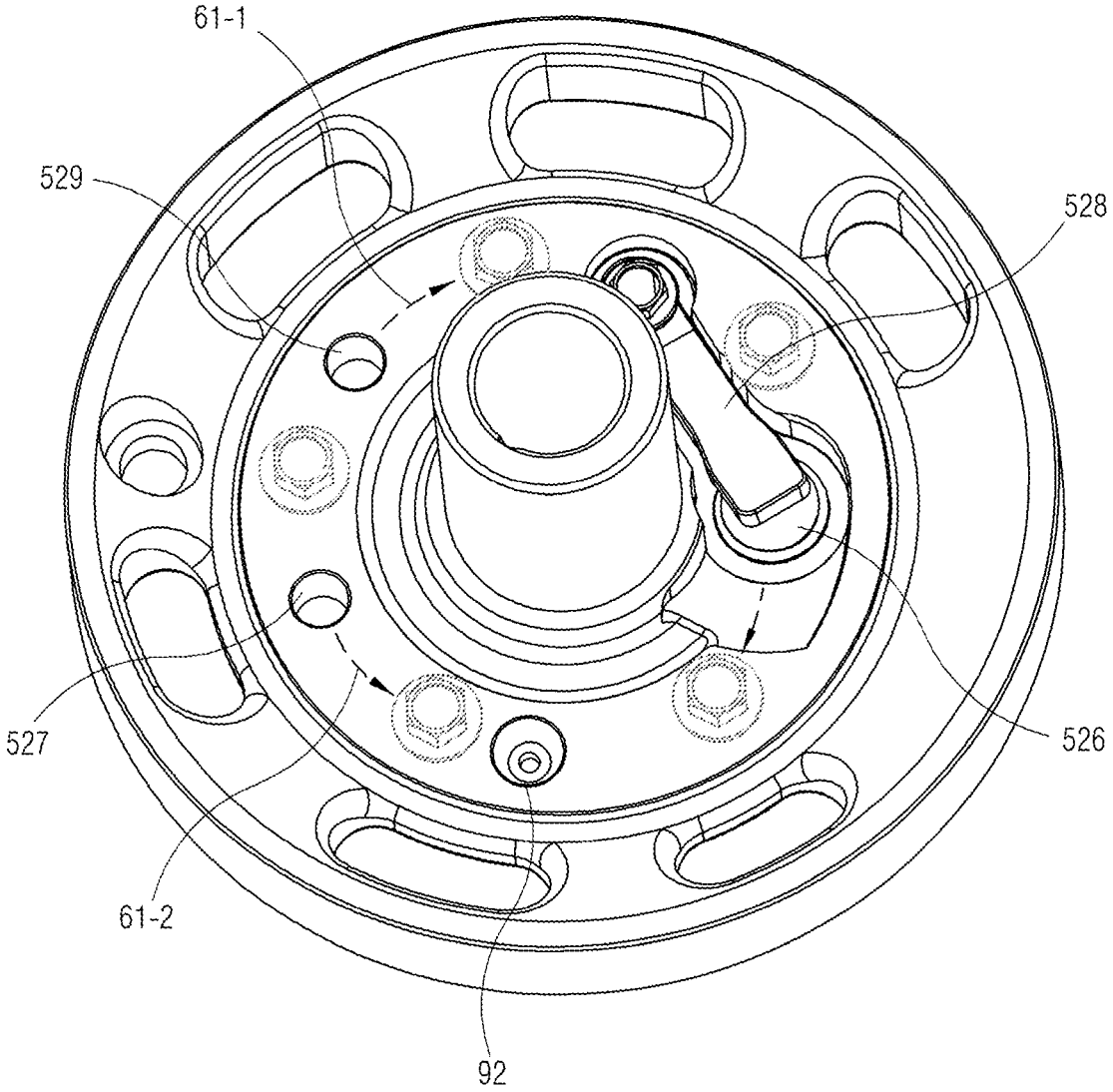
FIG. 10 is a perspective view illustrating a top surface of an upper flange in the compressor according to the embodiment of the disclosure.

FIG. 8 is a cross-sectional view of the compression part 40 and the gas moving part 50 in the compressor according to the embodiment of the disclosure illustrated in FIGS. 1 to 7, FIG. 9 is a perspective view illustrating a bottom surface of the lower flange 54 in the compressor 1 according to the embodiment of the disclosure illustrated in FIG. 4, and FIG. 10 is a perspective view of a top surface of the upper flange 52 in the compressor 1 according to the embodiment of the disclosure illustrated in FIG. 3.

As illustrated in FIG. 8, the gas moving part 50 includes the upper gas moving part 50-1 and the lower gas moving part 50-2. The upper gas moving part 50-1 includes the upper flange 52 coupled to the upper portion of the cylinder 42 and an upper muffler 56 coupled to a top surface portion 522 of the upper flange 52. The lower gas moving part 50-2 includes the lower flange 54 coupled to the lower portion of the cylinder 42 and a lower muffler 58 coupled to a bottom surface portion 544 of the lower flange 54.

The upper flange 52 includes the upper gas discharge port 526 that penetrates through the cylinder 42 and is formed at a position corresponding to the gas discharge channel 424 of the cylinder 42, an upper discharge valve 528 that is provided in the upper gas discharge port 526 and is opened and closed according to the pressure, and first and second connection outlets 527 and 529 that are provided to communicate with first and second gas flow path connecting parts 427 and 429 of the cylinder 42, respectively.

The lower flange 54 includes the lower gas discharge port 546 that penetrates through the cylinder 42 and is formed at a position corresponding to the gas discharge channel 424 of the cylinder 42, a lower discharge valve 548 that is provided in the lower gas discharge port 546 and is opened and closed according to the pressure, and first and second connection outlets 547 and 549 that are provided to communicate with first and second gas flow path connecting parts 427 and 429 of the cylinder 42, respectively.

In the upper muffler 56, the gas compressed in the cylinder 42 is discharged to the gas discharge port 526 of the upper flange 52 to pass through the upper first gas flow path 60, and the gas discharged to the first and second connection outlets 527 and 529 of the upper flange 52 passes through the upper second gas flow path 61, thereby reducing noise. The upper muffler 56 includes first to fifth expansion space parts 563-1 to 563-5 radially extending around a rotating shaft hole 561 as illustrated in FIGS. 3 and 4. The upper muffler 56 includes a narrow connecting passage provided between first and second expansion space parts 563-1 and 563-2, between second and third expansion space parts 563-2 and 563-3, and fourth and fifth expansion space parts 563-4 and 563-5. However, the first and fifth expansion space parts 563-1 and 563-5, and the third and fourth expansion space parts 563-3 and 563-4 may be shielded from each other. Obviously, each of the first to fifth expansion space parts 563-1 to 563-5 may all communicate with each other as needed. The first expansion space part 563-1 is provided corresponding to the position of the gas discharge port 526 of the upper flange 52. The second expansion space part 563-2 is provided corresponding to the position of the first muffler outlet 566. The third expansion space part 563-3 is provided corresponding to the position of the first connection outlet 527 of the upper flange 52. The fourth expansion space part 563-4 is provided corresponding to the position of the second connection outlet 529 of the upper flange 52. The fifth expansion space part 563-5 is provided corresponding to the position of the second muffler outlet 568.

The lower muffler 58 reduces noise by discharging the gas compressed in the cylinder 42 to the gas discharge port 546 of the lower flange 54 and passing the gas through the lower gas flow path 70. The lower muffler 58 includes first to third expansion space parts 581-1 to 583-3 radially extending around a rotating shaft hole 581 as illustrated in FIGS. 3 and 4. The first and second expansion space parts 563-1 and 563-2 may be connected to each other with a narrow width. The first and third expansion space parts 563-1 and 563-3 may be shielded from each other. The first expansion space part 583-1 is provided corresponding to the position of the gas discharge port 546 of the lower flange 54. The second expansion space part 563-2 is provided corresponding to the position of the first connection inlet 547 of the lower flange 54. The third expansion space part 563-3 is provided corresponding to the position of the second connection inlet 549 of the lower flange 54.

The upper gas moving part 50-1 includes the upper first gas flow path 60 and the upper second gas flow path 61 formed between the top surface portion (522 in FIG. 3) of the upper flange 52 and the inner surface portion (562 in FIG. 4) of the upper muffler 56.

As illustrated in FIGS. 8 and 10, the upper first gas flow path 60 and the upper second gas flow path 61 are spaced that are set by the top surface portion 522 of the upper flange 52 and the inner surface portion 562 of the upper muffler 56 and have a path in which gas rotates around the rotating shaft 20 along the flow path by the corresponding space. The upper first gas flow path 60 extends from the gas discharge port 526 of the upper flange 52 to the first muffler outlet 566 of the upper muffler 56. The upper first gas flow path 60 is set by the shape of the inner surface portion 562 of the upper muffler 56 because the top surface portion 522 of the upper flange 52 is flat. The second gas flow path 61 has two paths 61-1 and 61-2 that extend from the first and second connection outlets 527 and 529 connected to the lower gas flow path 70 of the lower gas moving part 50-2 to the first muffler outlet 566 and the second muffler outlet 568, respectively. That is, in the first muffler outlet 566, the gas discharged from the gas discharge port 526 of the upper flange 52 is not only discharged through the upper first gas flow path 60, but the gas discharged from the first connection outlet 527 is also discharged via the first path 61-1 of the second gas flow path 61. On the other hand, in the second muffler outlet 568, the gas discharged from the second connection outlet 529 is discharged via the second path 61-2.

The low gas moving part 50-2 includes the lower gas flow path 70 formed between the bottom surface portion (544 in FIG. 4) of the lower flange 54 and the inner surface portion (582 in FIG. 3) of the lower muffler 58.

As illustrated in FIGS. 3, 4, 8 and 9, the lower gas flow path 70 is a space set by the bottom surface portion 544 of the lower flange 54 and the inner surface portion of the lower muffler 58, and has a path that rotates around the rotating shaft 20. The lower gas flow path 70 extends from the gas discharge port 546 of the lower flange 54 toward the first and second connection inlets 547 and 549 of the lower flange 54. The lower gas flow path 70 is set by the shape of the inner surface portion 582 of the lower muffler 58 because the bottom surface portion 544 of the lower flange 54 is flat.

As illustrated in FIG. 9, the bottom surface portion 544 of the lower flange 54 is provided with first and second noise reduction resonators 72 and 74 between the gas discharge port 546 and the first connection inlet 547 of the lower flange 54. The first and second noise reduction resonators 72 and 74 communicate with the lower gas flow path 70 and have the resonance space depressed upward in the moving direction of the gas. The second noise reduction resonator 74 may be disposed adjacent to or spaced apart from the first noise reduction resonator 72. Further, the lower gas flow path 70 may be provided with only the first noise reduction resonator 72, or three or more noise reduction resonators of the same or different shapes may be provided.

Figure 11:
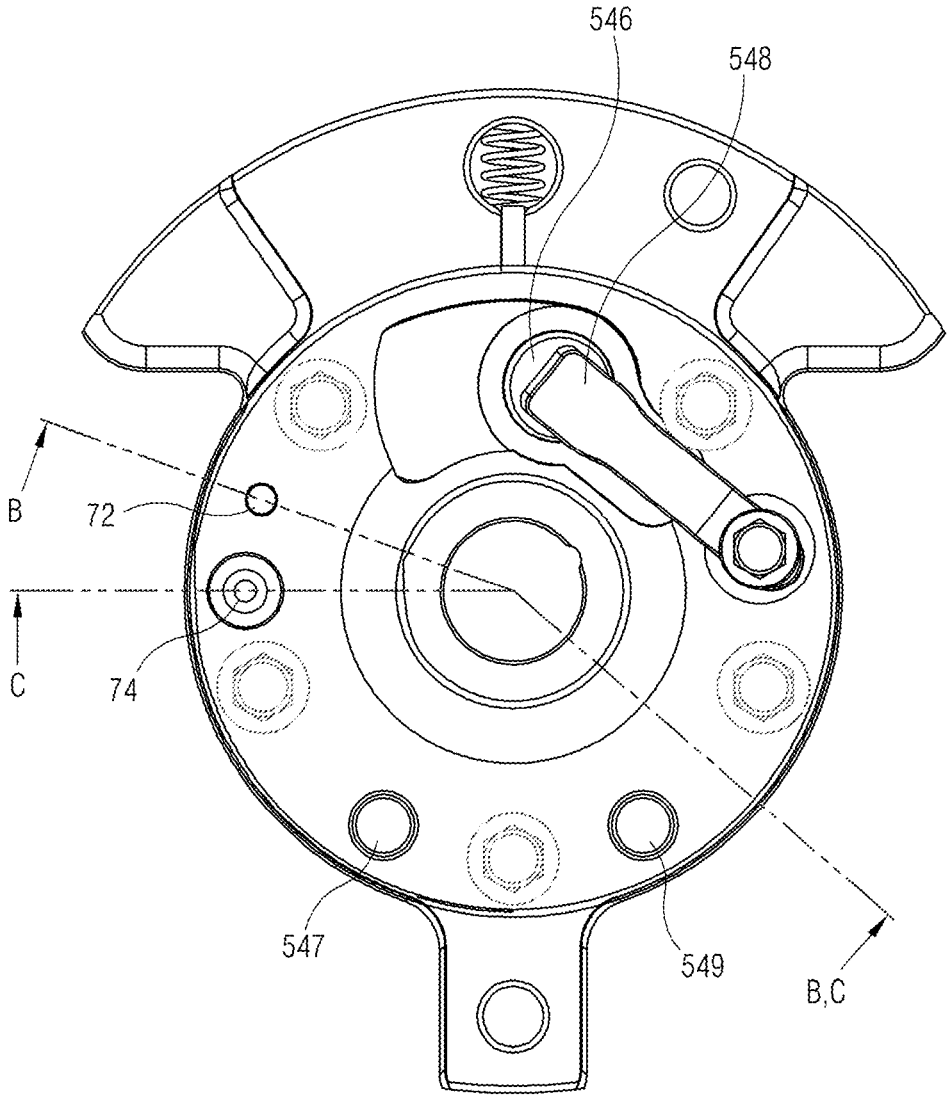
FIG. 11 is a bottom view illustrating the bottom surface of the compression part in the compressor according to an embodiment of the disclosure.
Figure 12:
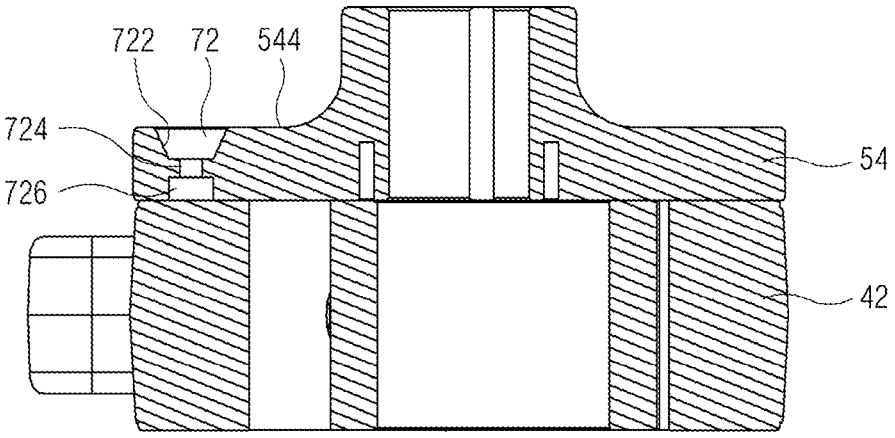
FIGS. 12 and 13 are cross-sectional views taken along lines B-B and C-C of FIG. 11.
Figure 13:
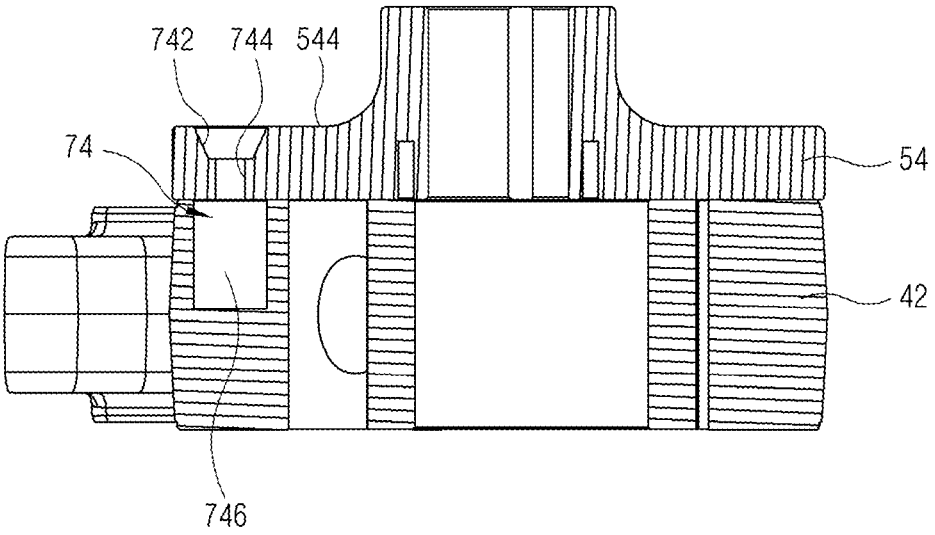

FIG. 11 is a bottom view illustrating the bottom surface of the compression part in the compressor according to the embodiment of the disclosure, and FIGS. 12 and 13 are cross-sectional views taken along lines B-B and C-C of FIG. 11.

As illustrated in FIG. 12, the first noise reduction resonator 72 includes a truncated cone-shaped inlet part 722 that gradually narrows inward from the bottom surface portion 544 of the lower flange 54, a cylindrical neck part 724 that extends upward to a diameter smaller than or equal to a rear end diameter of the inlet part 722, and a cylindrical chamber 726 that has a diameter larger than that of the neck part 724 and extends to an upper end of the lower flange 54 The upper end of the cylindrical chamber 726 is shielded by a lower end of the cylinder 42.

The gas discharged from the compression part 40 of the compressor 1 is introduced into the chamber 726 through the inlet part 722 and the neck part 724 while passing through the lower gas flow path 70. The introduced gas resonates at a resonance frequency (target frequency) of the neck part 724 and the chamber 726, and the noise component of the corresponding frequency is converted into thermal energy, thereby reducing the size.

In particular, since the first noise reduction resonator 72 according to the disclosure is depressed upward in the moving direction of gas, foreign objects or liquids may not remain in the chamber 726.

As illustrated in FIG. 13, the second noise reduction resonator 74 includes a truncated cone-shaped inlet part 742 that gradually narrows upward from the bottom surface portion of the lower flange 54, a cylindrical neck part 744 that extends upward to the upper end of the lower flange 54 with a diameter narrower than or equal to a rear end diameter of the inlet part 742, and a cylindrical chamber 746 whose diameter is larger than the neck part 724 from the lower end of the cylinder 42 to the upper portion.

The gas discharged from the compression part 40 of the compressor 1 is introduced into the chamber 746 through the inlet part 742 and the neck part 744 after passing through the first noise reduction resonator 72 while passing through the lower gas flow path 70. The introduced gas resonates at a resonance frequency (target frequency) of the neck part and the chamber, and the noise component of the corresponding frequency is converted into thermal energy, thereby reducing the size. At this time, the second noise reduction resonator 74 is formed up to the cylinder 42 deeper than the first noise reduction resonator 72 to resonate noise of a frequency different from the frequency reduced by the first noise reduction resonator 72.

Similarly, since the noise reduction resonator 74 according to the disclosure is depressed upward in the moving direction of gas, foreign objects or liquids may not remain in the chamber 746.

Figure 14:
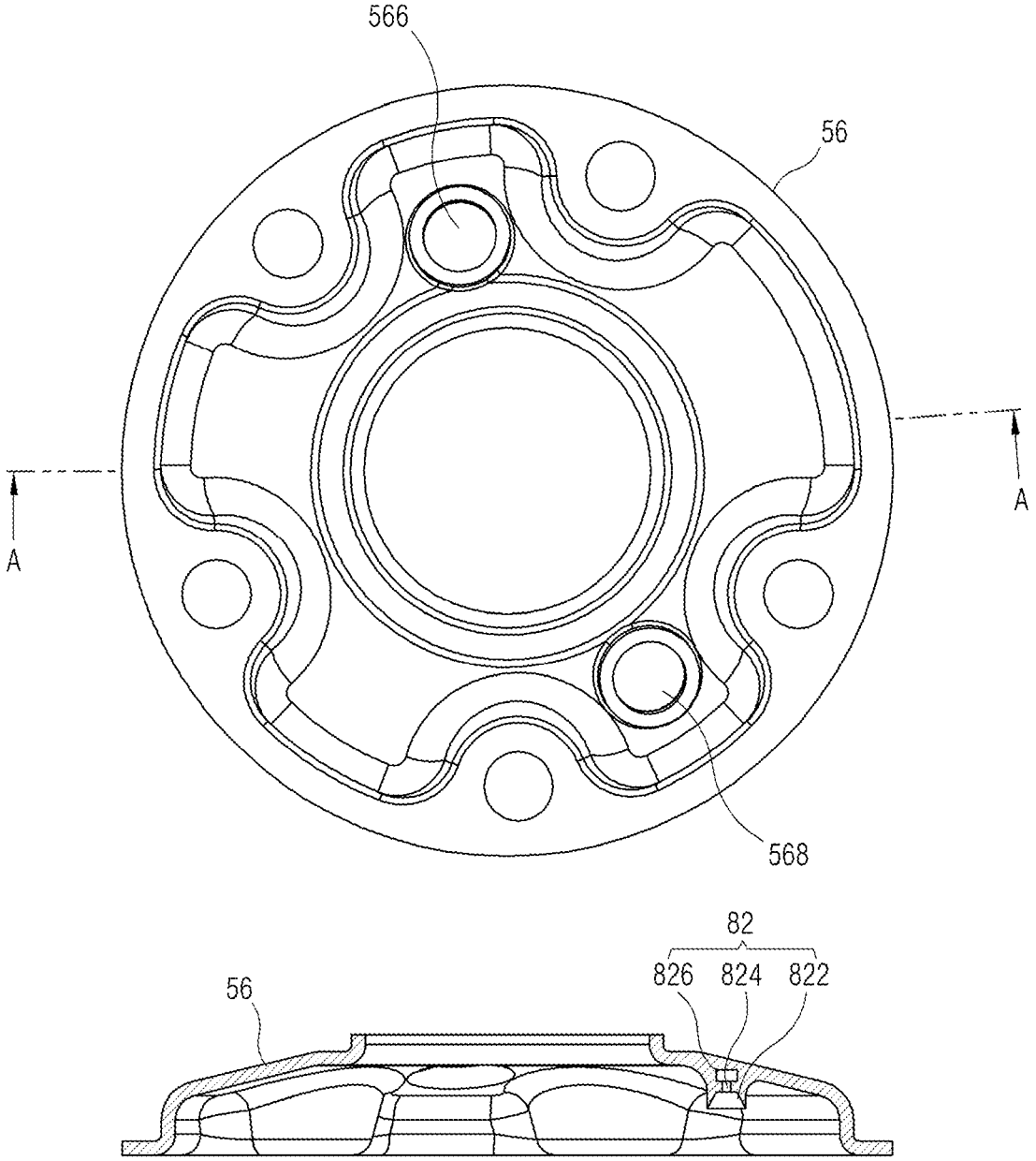
FIG. 14 is a cross-sectional view illustrating an upper muffler in the compressor according to the embodiment of the disclosure.

FIG. 14 is a cross-sectional view illustrating the upper muffler 56 in the compressor according to the embodiment of the disclosure. The upper muffler 56 has a third noise reduction resonator 82 formed on the inner surface thereof to reduce noise of gas passing through the upper first gas flow path 60 or the upper second gas flow path 61. The third noise reduction resonator 82 communicates with the upper first gas flow path 60 or the upper second gas flow path 61 and has the resonance space depressed upward in the moving direction of the gas. The compressor 1 may include only the third noise reduction resonator 82 without the first and second noise reduction resonators 72 and 74. The compressor 1 may further include the third noise reduction resonator 82 together with the first and second noise reduction resonators 72 and 74 of FIG. 9. Alternatively, the compressor 1 may further include the third noise reduction resonator 82 together with either the first or second noise reduction resonator 72 and 74 of FIG. 9. Two or more noise reduction resonators having the same shape or different shapes may be provided in the upper muffler 56 of the compressor 1.

As illustrated, the third noise reduction resonator 82 includes a truncated cone-shaped inlet part 822 that gradually narrows upward from the inner surface portion 562, a cylindrical neck part 824 that extends upward with a diameter smaller than or equal to the rear end diameter of the inlet part 822, and a cylindrical chamber 846 whose diameter is larger than that of the neck part 824.

Figure 15:
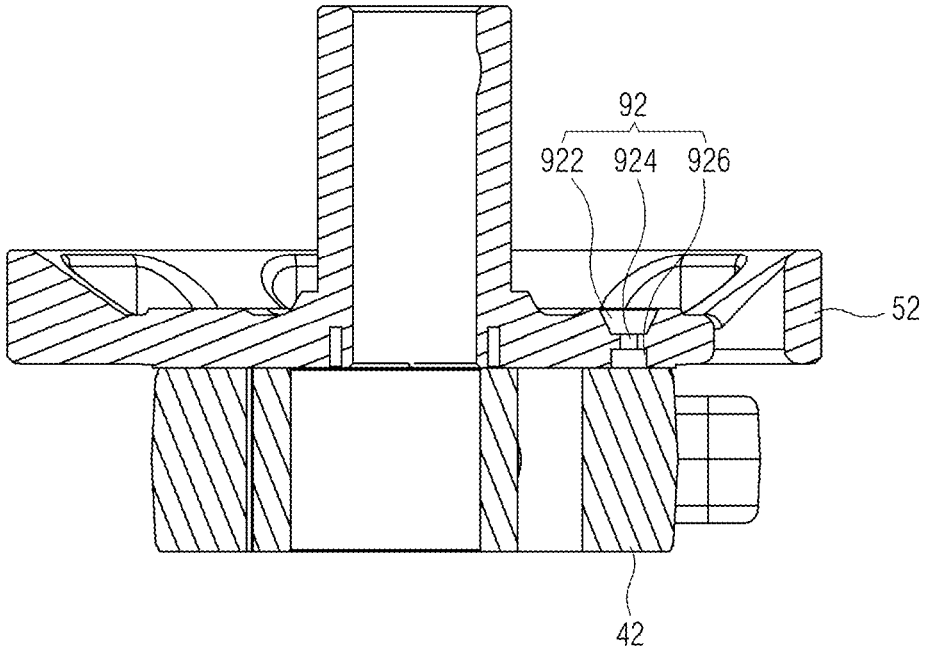
FIG. 15 is a cross-sectional view illustrating a cross section of the upper flange in the compressor according to the embodiment of the disclosure.

FIG. 15 is a cross-sectional view illustrating a cross section of the upper flange 52 in the compressor 1 according to the embodiment of the disclosure. As illustrated, the upper flange 52 has a fourth noise reduction resonator 92 to reduce noise of gas passing through the upper first gas flow path 60 or the upper second gas flow path 61. The fourth noise reduction resonator 92 communicates with the upper first gas flow path 60 or the upper second gas flow path 61 and has the resonance space depressed upward in the moving direction of the gas. The compressor 1 may further include a fourth noise reduction resonator 92 together with at least one of the first and second noise reduction resonators 72 and 74 of FIG. 9 and the third noise reduction resonator 82 of FIG. 14. In the compressor 1, two or more noise reduction resonators having the same shape or different shapes may be provided on the upper flange 52.

As illustrated, the fourth noise reduction resonator 92 includes a truncated cone-shaped inlet part 922 that gradually narrows downward from the top surface portion 522, a cylindrical neck part 824 that extends upward with a diameter smaller than or equal to the rear end diameter of the inlet part 922, and a cylindrical chamber 926 that has a diameter larger than that of the neck part 824 and extends to the lower end of the upper flange 52. The lower end of the cylindrical chamber 926 is shielded by the upper end of the cylinder 42.

Figure 16:
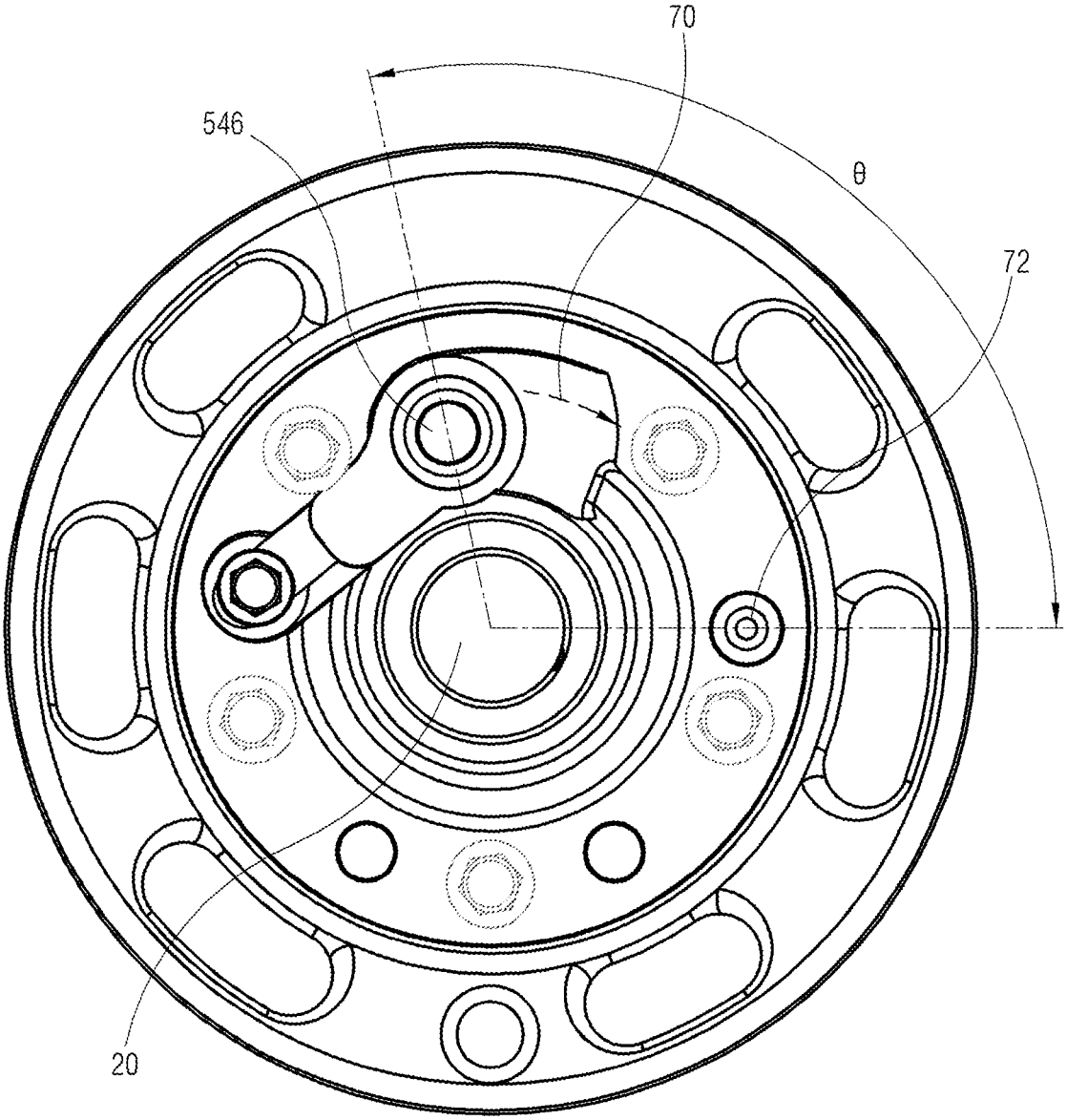
FIG. 16 is a bottom view illustrating the bottom surface of the lower flange in the compressor according to the embodiment of the disclosure.

FIG. 16 is a bottom view illustrating the bottom surface of the lower flange 54 in the compressor 1 according to the embodiment of the disclosure. As illustrated, the first or second noise reduction resonator 72 or 74 is located within a predetermined angle θ, for example, 170° from the gas discharge port 546 of the lower flange 54 around the rotating shaft 20, which is effective for noise reduction.

Figure 17:
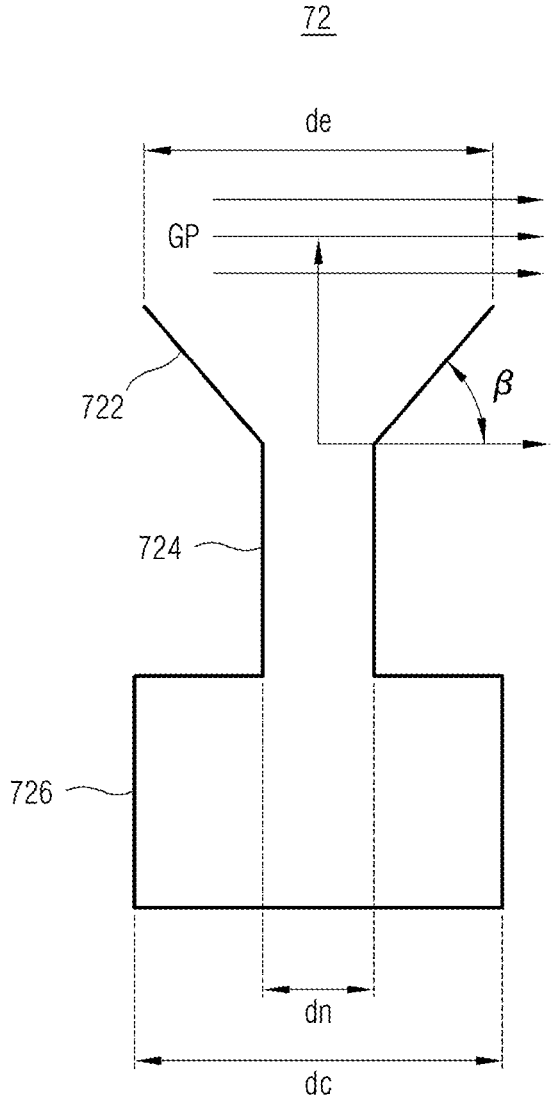
FIGS. 17 to 19 are diagrams illustrating a noise reduction resonator according to first to third embodiments of the disclosure.
Figure 18:
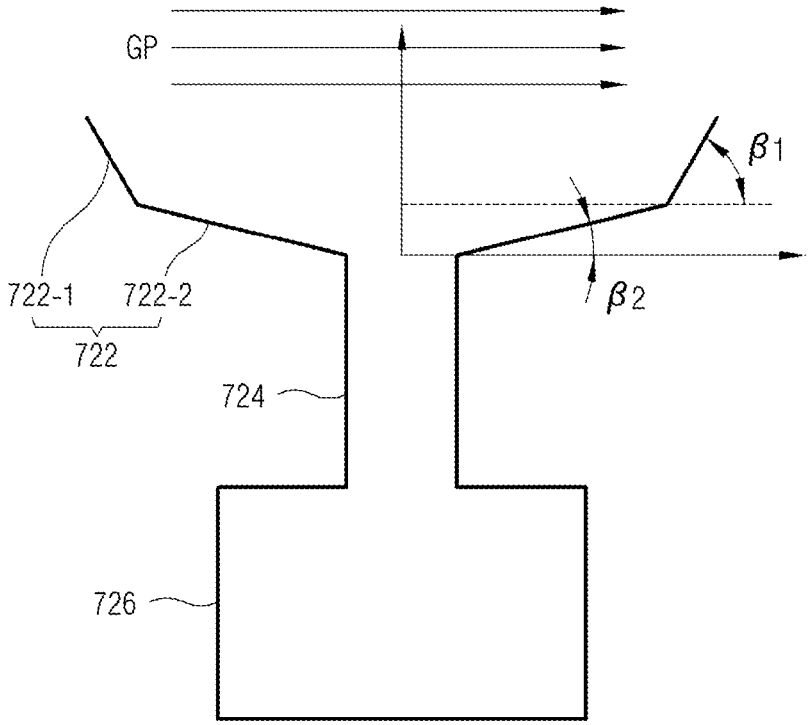
Figure 19:
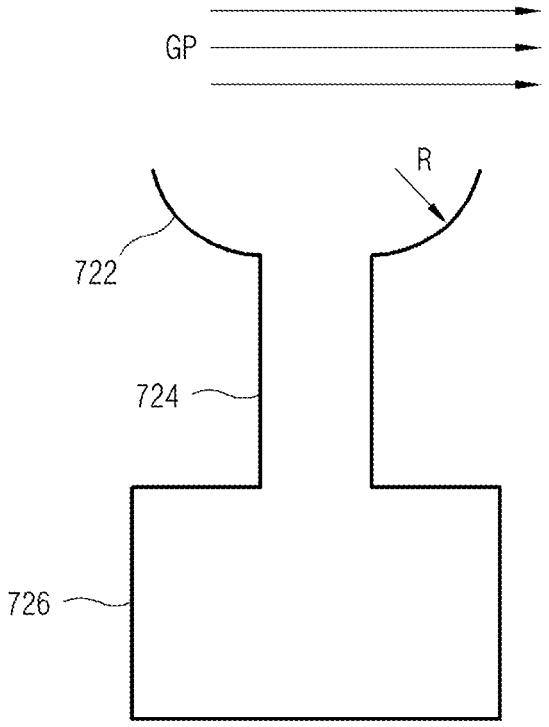

FIGS. 17 to 19 are diagrams illustrating the shape of the noise reduction resonator according to the first to third embodiments of the disclosure. The shape of the noise reduction resonator according to the first to third embodiments may be applied to the first to fourth noise reduction resonators 72, 74, 82, and 92 according to the disclosure.

As illustrated in FIGS. 17 to 19, the noise reduction resonator 72 of the first to includes a truncated cone-shaped inlet part 722 that gradually narrows, a cylindrical neck part 724 that extends upward with a diameter smaller than or equal to the rear end diameter of the inlet part 722, and a cylindrical chamber 726 whose diameter is larger than that of the neck part 724.

In FIG. 17, the inlet part 722 has an inclined portion inclined at a predetermined angle β with respect to a vertical axis of a traveling direction GP of gas. At this time, the inclined inlet part 722 may reduce noise generated when gas traveling along the gas flow paths 60, 61, and 70 is introduced into the noise reduction resonator 72.

In FIG. 17, when the chamber 726 and the neck part 724 may each have a cylindrical shape that has a first diameter $d_c$ and a second diameter $d_n$, the second diameter $d_n$ may be set to be 10 to 90% relative to the first diameter $d_c$ in consideration of the noise reduction. When the inlet part 722 has a truncated cone shape that decreases from a maximum diameter $de_{max}$ to a minimum diameter $de_{min}$ in consideration of the noise reduction, the maximum diameter $de_{max}$ may be designed to be larger than the first diameter $d_c$.

In FIG. 18, the inlet part 722 is a first inclined portion 722-1 inclined at a first angle β1 and a second inclined portion 722-2 inclined at a second angle β2 with respect to the vertical axis of the traveling direction GP of gas. In this case, the first angle β1 should be smaller than the second angle β2. In this way, the inclined inlet part 722 may reduce noise generated when gas traveling along the gas flow paths 60, 61, and 70 is introduced into the noise reduction resonator 72. Obviously, the inlet part 722 may include three or more inclined portions.

In FIG. 19, the inlet part 722 has an inclined portion inclined at a predetermined curvature R with respect to the vertical axis of the traveling direction GP of gas. In this way, the inlet part 722 inclined with a curvature may reduce noise generated when the gas traveling along the gas flow paths 60, 61, and 70 is introduced into the noise reduction resonator 72. Obviously, the inlet part 722 may include multi-stage curvature inclined portions having two or more different curvatures.

Figure 20:
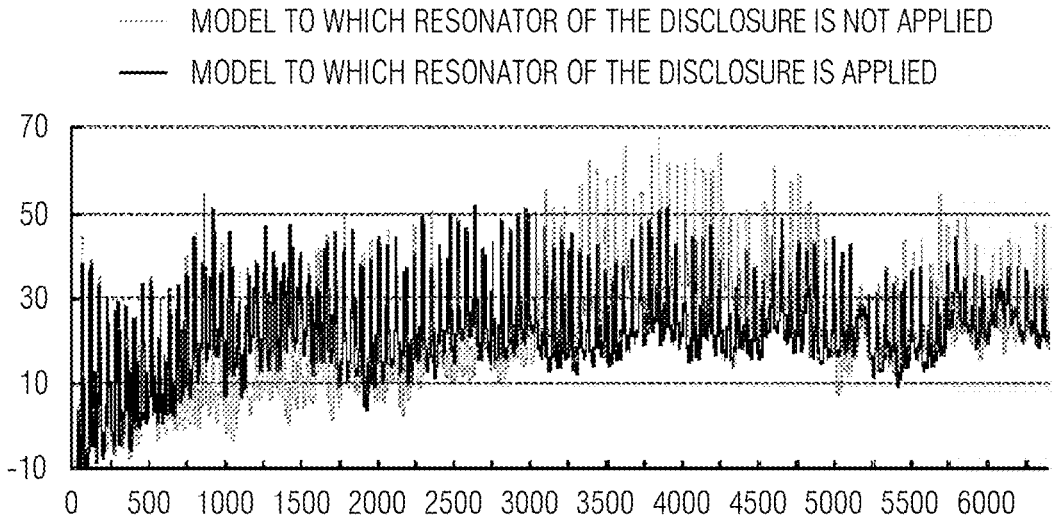
FIG. 20 is a frequency waveform illustrating a comparison of noise measurement results of the compressor to which the noise reduction resonator according to the embodiment of the disclosure is applied and the compressor to which the noise reduction resonator is not applied.

FIG. 20 is a frequency waveform illustrating a comparison of noise measurement results of the compressor to which the noise reduction resonator according to the embodiment of the disclosure is applied and the compressor to which the noise reduction resonator is not applied.

As illustrated in FIG. 20, as a result of the evaluation by applying the noise reduction resonator 72 having a target frequency of 3800 Hz to the compressor 1 according to the disclosure, the efficiency of the compressor 1 is the same, but the overall noise is reduced from 74.9 dB to 69.4 dB, thereby obtaining the reduction effect of about 5.5 dB.

In this way, the compressor according to the disclosure may prevent the compression efficiency from decreasing and maintain the noise reduction effect for a long period of time by preventing foreign objects or liquids from being accumulated in the resonance space.

Although the preferred embodiments of the disclosure have been illustrated and described above, the disclosure is not limited to the specific embodiments described above, and can be variously modified by those skilled in the art to which the disclosure pertains without departing from the gist of the disclosure claimed in the claims, and these modifications should not be understood individually from the technical ideas or prospects of the disclosure.

The invention claimed is:

1. A compressor, comprising:

a compression part comprising compression space in which gas is to be accommodated, and configured to compress and discharge the gas accommodated in the compression space; and a first gas moving part comprising a first gas flow path through which the gas discharged from the compression space moves, wherein the first gas moving part includes a first resonator configured to communicate with the first gas flow path, and comprising a resonance space depressed upward in a moving direction of the gas, and the first resonator further comprising:

an inlet part configured to communicate with the first gas flow path;

a neck part configured to extend from the inlet part; and a chamber configured to extend from the neck part, and having a larger diameter than a diameter of the neck part, and wherein the inlet part comprises an inclined portion configured to be inclined to narrow toward the neck part.

2. The compressor of claim 1, wherein the compression part comprises a cylinder forming the compression space, and wherein the first gas moving part comprises:

a lower flange coupled to a lower portion of the cylinder and comprising a gas discharge port for discharging the gas compressed in the compression space; and a lower muffler coupled to the lower flange to form the first gas flow path.

3. The compressor of claim 2, further comprising:

a second gas moving part comprising a second gas flow path through which the gas discharged from the compression space moves, wherein the second gas moving part comprises:

an upper flange coupled to an upper portion of the cylinder and comprising a gas discharge port for discharging the gas compressed in the compression space; and an upper muffler coupled to the upper flange to form the second gas flow path, and wherein the second gas moving part is provided with a second resonator configured to communicate with the second gas flow path and comprising a resonance space depressed upward in a moving direction of the gas.

4. The compressor of claim 2, further comprising:

a second gas moving part comprising a second gas flow path through which the gas discharged from the compression space moves, wherein the second gas moving part comprises:

an upper flange coupled to an upper portion of the cylinder and comprising a gas discharge port for discharging the gas compressed in the compression space; and an upper muffler coupled to the upper flange to form the second gas flow path, and wherein the second gas moving part is provided with a second resonator configured to communicate with the second gas flow path and comprising a resonance space depressed downward in a moving direction of the gas.

5. The compressor of claim 4, wherein the second gas moving part comprises a third gas flow path, and wherein the first gas flow path and the third gas flow path are connected to each other.

6. The compressor of claim 5, wherein the second gas flow path and the third gas flow path are configured to communicate with each other.

7. The compressor of claim 2, wherein the first gas moving part is further provided with a second resonator configured to communicate with the first gas flow path and comprising a resonance space depressed upward in a moving direction of the gas, and wherein the second resonator is configured to be depressed across the lower flange and the cylinder.

8. The compressor of claim 2, wherein the first resonator is located within a range of 170° from the gas discharge port with respect to a center of the lower flange.

9. The compressor of claim 1, wherein the compression part comprises a cylinder forming the compression space, and wherein the first gas moving part comprises:

an upper flange coupled to an upper portion of the cylinder and comprising a gas discharge port for discharging the gas compressed in the compression space; and an upper muffler coupled to the upper flange to form the first gas flow path.

10. The compressor of claim 1, wherein the first gas moving part is further provided with a second resonator configured to communicate with the first gas flow path and comprising a resonance space depressed upward in a moving direction of the gas, and wherein the second resonator comprises a resonance space having a depth different from that of the first resonator.

11. The compressor of claim 1, wherein the inclined portion is configured to be inclined with respect to a vertical axis of the moving direction of the gas to narrow toward the neck part.

12. The compressor of claim 1, wherein the chamber and the neck part each comprise a cylindrical shape having a first diameter $d_c$ and a second diameter $d_n$, and wherein the second diameter $d_n$ is 10 to 90% relative to the first diameter $d_c$.

13. The compressor of claim 1, wherein the chamber and the neck part each comprise a cylindrical shape having a first diameter $d_c$ and a second diameter $d_n$, and wherein the inlet part has a truncated cone shape that decreases from a maximum diameter $de_{max}$, to a minimum diameter $de_{min}$, and wherein the maximum diameter $de_{max}$ is greater than the first diameter $d_c$.

14. An electronic device, comprising:

a compressor, wherein the compressor comprises:

a cylinder comprising a compression space in which introduced gas is to be accommodated, and configured to compress and discharge the gas accommodated in the compression space; and a lower flange coupled to the lower part of the cylinder;

a lower muffler coupled to a bottom surface portion of the lower flange and comprising an inner surface portion forming a gas flow path through which the gas discharged from the compression space moves together with the bottom surface portion of the lower flange; and a resonator formed on a bottom surface portion of the lower flange, and configured to communicate with the gas flow path, the resonator comprising:

a resonance space depressed upward in a moving direction of the gas;

an inlet part configured to communicate with the first gas flow path;

a neck part configured to extend from the inlet part; and a chamber configured to extend from the neck part, and comprising a larger diameter than the neck part, wherein the inlet part comprises an inclined portion configured to be inclined to narrow toward the neck part.

* * * * *